US005944641A

United States Patent [19]

Habing

[11] Patent Number: 5,944,641

[45] Date of Patent: Aug. 31, 1999

[54] EXERCISE MACHINE

[75] Inventor: Theodore G. Habing, Santa Ana, Calif.

[73] Assignee: TNWK Corporation, Santa Ana, Calif.

[21] Appl. No.: 08/938,770

[22] Filed: Sep. 26, 1997

Related U.S. Application Data

[63] Continuation-in-part of application No. 08/696,140, Aug. 13, 1996, which is a continuation of application No. 08/261,727, Jun. 17, 1994, abandoned, which is a continuation of application No. 08/142,620, Oct. 25, 1993, Pat. No. 5,330,405.

[51] Int. Cl.[6] ..... A63B 2/068

[52] U.S. Cl. ..... 482/96; 482/133; 482/138

[58] Field of Search ..... 482/95, 96, 99, 482/100, 133–138

[56] References Cited

U.S. PATENT DOCUMENTS

| | | |
|---|---|---|
| 197,750 | 12/1877 | Tuttle . |
| 232,217 | 9/1880 | Tuttle . |
| 248,121 | 10/1881 | Tuttle . |
| D. 324,710 | 3/1992 | Habing . |
| 3,446,503 | 5/1969 | Lawton . |
| 4,300,760 | 11/1981 | Bobroff . |
| 4,358,108 | 11/1982 | Voris . |
| 4,627,616 | 12/1986 | Kauffman . |
| 4,632,390 | 12/1986 | Richey . |
| 4,634,118 | 1/1987 | Jensen . |
| 4,655,448 | 4/1987 | Harder . |
| 4,809,972 | 3/1989 | Rasmussen et al. . |
| 4,844,456 | 7/1989 | Habing et al. . |
| 4,949,958 | 8/1990 | Richey . |
| 5,085,430 | 2/1992 | Habing . |
| 5,194,059 | 3/1993 | Yu . |
| 5,221,245 | 6/1993 | Yeh . |
| 5,230,680 | 7/1993 | Yu . |
| 5,236,406 | 8/1993 | Webber . |
| 5,330,405 | 7/1994 | Habing et al. ..... 482/96 |

FOREIGN PATENT DOCUMENTS

| | | |
|---|---|---|
| 445629 | 11/1912 | France . |
| 1674870 | 9/1991 | U.S.S.R. . |
| 1674871 | 9/1991 | U.S.S.R. . |
| 1674872 | 9/1991 | U.S.S.R. . |
| 1674873 | 9/1991 | U.S.S.R. . |
| 1674874 | 9/1991 | U.S.S.R. . |
| 1674875 | 9/1991 | U.S.S.R. . |
| 1683789 | 10/1991 | U.S.S.R. . |

OTHER PUBLICATIONS

The Gravit Edge Owner's Manual, Copyright 1993, SLM Fitness.
Brochure, The Gravity Edge, publication date unstated.
Advertisement—"Bodyforce" by Maximus—1 page.
Brochure—Total Gym Pull–Up Attachment—2 pages.
Stearns Bench—photo and drawing—2 pages.
Weslo *Body Focus Owner'Manual* 16 pages, © 1994.
ProForm *BodyLift Excercise Guide* 14 pages, © 1994.
ProForm *BodyLift Owner's Manual* 16 pages, © 1994.

*Primary Examiner*—John Mulcahy
*Attorney, Agent, or Firm*—Blakely, Sokoloff,Taylor & Zafman LLP

[57] ABSTRACT

A multi-station exercise machine has a movable subframe on which a user sits while performing various exercises. The subframe is movably coupled to a stationary frame and is supported by a lever arm that is pivotally attached to the stationary frame. A cable and pulley system couples the lever arm to the various operable members of the apparatus so that a selectable ratio of the weight of the subframe, including the user, is communicated as exercise resistance. The main structural member of the subframe may be disconnected so that the upper portion of the subframe may be folded down for convenient shipping and/or storage of the apparatus.

5 Claims, 6 Drawing Sheets

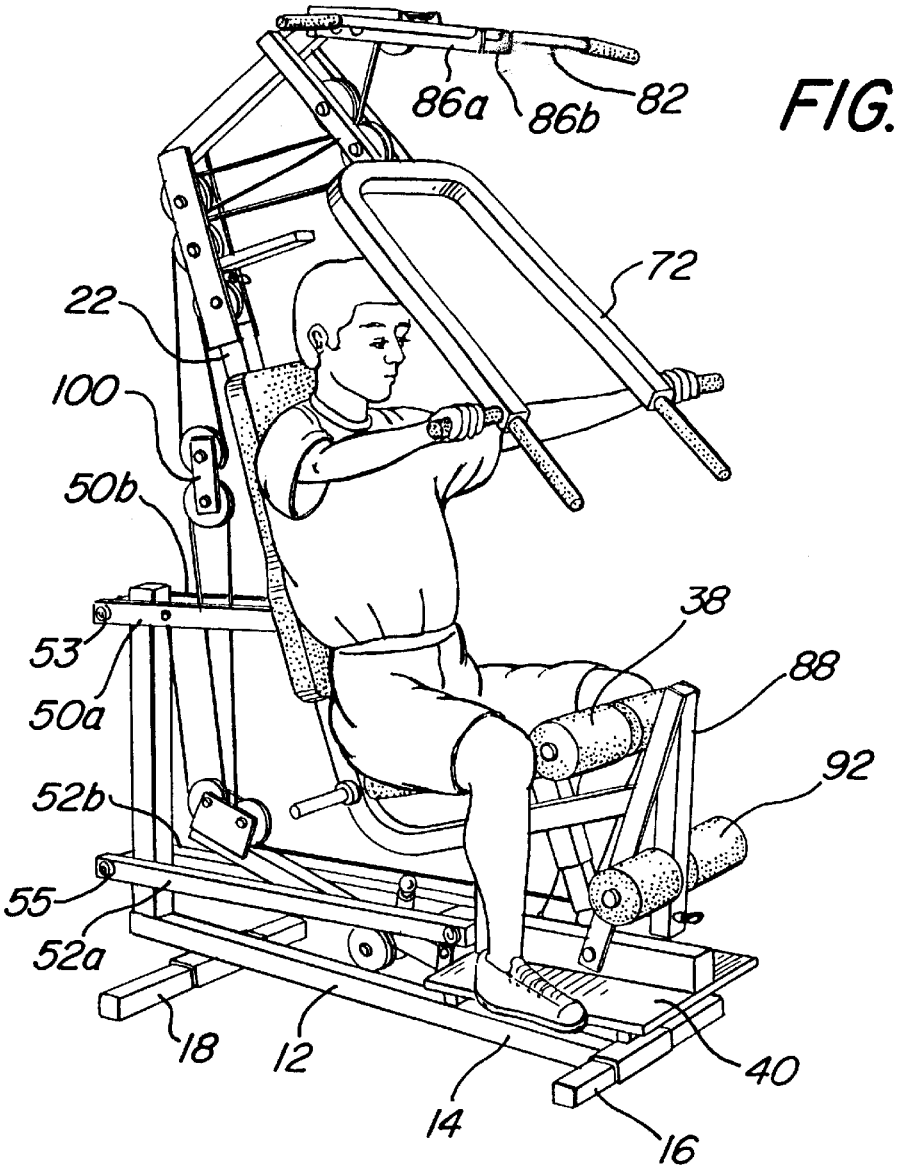
FIG. 1
FIG. 4
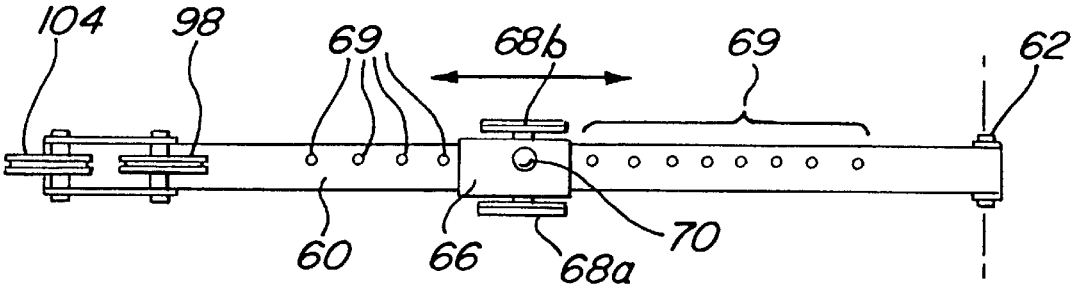

82
72
84
22
24a
100
54
53
50a
25
94
60
24b
56
46
55
52a
68a
66
12
47

EXERCISE MACHINE

RELATED APPLICATIONS

This is a continuation-in-part of co-pending application Ser. No. 08/696,140 filed Aug. 13, 1996, which is a continuation of Ser. No. 08/261,727 filed Jun. 17, 1994, now abandoned, which is a continuation of Ser. No. 08/142,620 filed Oct. 25, 1993, now U.S. Pat. No. 5,330,405.

BACKGROUND OF THE INVENTION

1. Field of the Invention

This invention relates to the field of exercise equipment, and particularly to an exercise machine in which at least a substantial portion of the exercise resistance is provided by the body weight of the operator.

2. Background Art

A wide variety of exercise machines have been developed for exercising various muscle groups of the body. Most such machines employ weights to provide resistance to the operator's exercise movements. Most commonly, a stack of individual weight plates is provided in an arrangement such that a selected number of the weight plates may be coupled to the exercise station by a cable, lever mechanism or other device. Exercise machines of this type typically have a weight stack with a total weight of 200 to 300 pounds. Such weights represent a significant fraction of the cost of an exercise machine, especially when transportation costs are considered. Moreover, conventional weight plates are noisy when the exercise machine is in use.

The use of a person's own body weight as a source of exercise resistance is, of course, well known. For example, many calisthenic exercises, such as push-ups, sit-ups and the like, employ body weight as a source of exercise resistance. Several types of exercise apparatus that use body weight resistance have been commercially introduced. For example, the HealthRider® is a device for simultaneously exercising muscle groups of the upper and lower body in which the operator is alternately raised and lowered on a seat by operation of the apparatus. The Total Gym®, marketed by EFI/Total Gym, employs an inclined sled to support the operator. Various exercises available with this machine cause the sled to be pulled up the incline as the operator exercises. The Body Force™, marketed by Maximus, provides a selectable amount of assistance to an operator while performing body weight exercises such as dips and chin-ups. The Gravity Edge™ has a pivoted platform on which the operator is supported in either a sitting or standing position. The platform is coupled by linkage to an exercise arm such that operation of the exercise arm causes the platform to be lifted.

Other variations of body weight exercise machines are shown in U.S. Pat. Nos. 4,632,390 and 4,949,958, both issued to Richey. These patents disclose devices in which an operator is supported on a generally horizontal bench which is lifted by various exercises. A roller and lever arm arrangement provides adjustment for the amount of body weight that is communicated as exercise resistance.

The various body weight resistance machines mentioned above provide a relatively limited selection of exercises compared to more conventional multi-station exercise machines that employ weight stacks. The latter class of machines has found wide acceptance among exercisers in both the home and health club markets. There is a perceived need for an exercise machine that combines the exercise flexibility of a conventional multi-station exercise machine with the advantages of a machine that derives exercise resistance from the operator's own body weight.

BRIEF SUMMARY OF THE INVENTION

The present invention provides a multi-station exercise machine that has a plurality of exercise members similar in nature to those that are afforded on conventional multi-station exercise machines which utilize a weight stack for providing exercise resistance. Various operable members for performing exercises are coupled to a movable subframe, which also supports a seat for the operator. The subframe is pivotally attached to a stationary frame. In a preferred embodiment of the invention, a lever arm is also pivotally attached to the stationary frame. A carriage movably located on the lever arm acts against a pivot arm that suspends the subframe from the stationary frame. A cable and pulley system couples the lever arm to the various operable members of the apparatus so that a selectable ratio of the weight of the subframe, including the operator, is communicated as exercise resistance. The amount of weight that is coupled to the operable members is selected by positioning the carriage on the lever arm. This adjustment also varies the height to which the subframe is lifted by the exercise stroke and hence the effort that must be exerted by the operator.

In effect, the subframe is a complete multi-station exercise machine, except only for the weights used in conventional exercise machines. The weight of the subframe together with that of the operator is generally more than adequate for providing any desired level of exercise resistance. Thus, the use of a weight stack as has heretofore been conventional with exercise machines of this class is not required. Apart from the advantage of dispensing with conventional weights, the present invention provides a new and exciting exercise sensation as the operator feels the lifting movement while exercising.

In one embodiment of the invention, the subframe comprises a generally L-shaped member having a seat and back rest for the operator. The subframe is pivotally coupled to the stationary frame with a four-bar linkage. A press arm is pivotally attached to an extension of the subframe at a pivot location generally above the operator's head. This embodiment of the invention employs two interconnected cables. A first cable is threaded through sets of pulleys on both the subframe member and the press arm and is coupled at one end thereof to a lat bar. The other end of the first cable is made available as an intermediate pulling point generally behind the operator's head. The subframe also carries a leg extension arm pivotally suspended forward of the operator's seat and coupled to a second cable. The end of the second cable is made available as a low pulling point. The cables are interconnected by a floating pulley assembly such that operation of any of the operable members or cable pulling points is communicated through the entire cable and pulley system to tension both of the cables. The second cable is threaded through pulleys mounted on the lever arm so that any of the exercise movements will exert a pulling force on the lever arm, thereby lifting the subframe from its rest position to a height that is determined by the selected position of the carriage.

The main L-shaped member of the subframe is preferably constructed so that it is separable at a location between the seat and backrest. Separating the subframe member at this location allows the upper portion of the subframe to be folded down to place the apparatus in a more compact configuration for shipping or storage.

In an alternative embodiment of the invention, the subframe is coupled to the stationary frame at a single pivot and only a single cable is employed. This embodiment foregoes an intermediate pulling point so that a single cable can be used. An operator of the machine is nevertheless able to perform lat pull/row, press, leg extension and low pull exercises.

BRIEF DESCRIPTION OF THE DRAWINGS

FIG. 1 is a perspective view of an exercise machine according to the present invention.

FIG. 4 is a detailed top plan view of the lever arm of the exercise machine of FIG. 1.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known exercise methods and devices are omitted so as to not obscure the description of the present invention with unnecessary detail.

Figure 2:
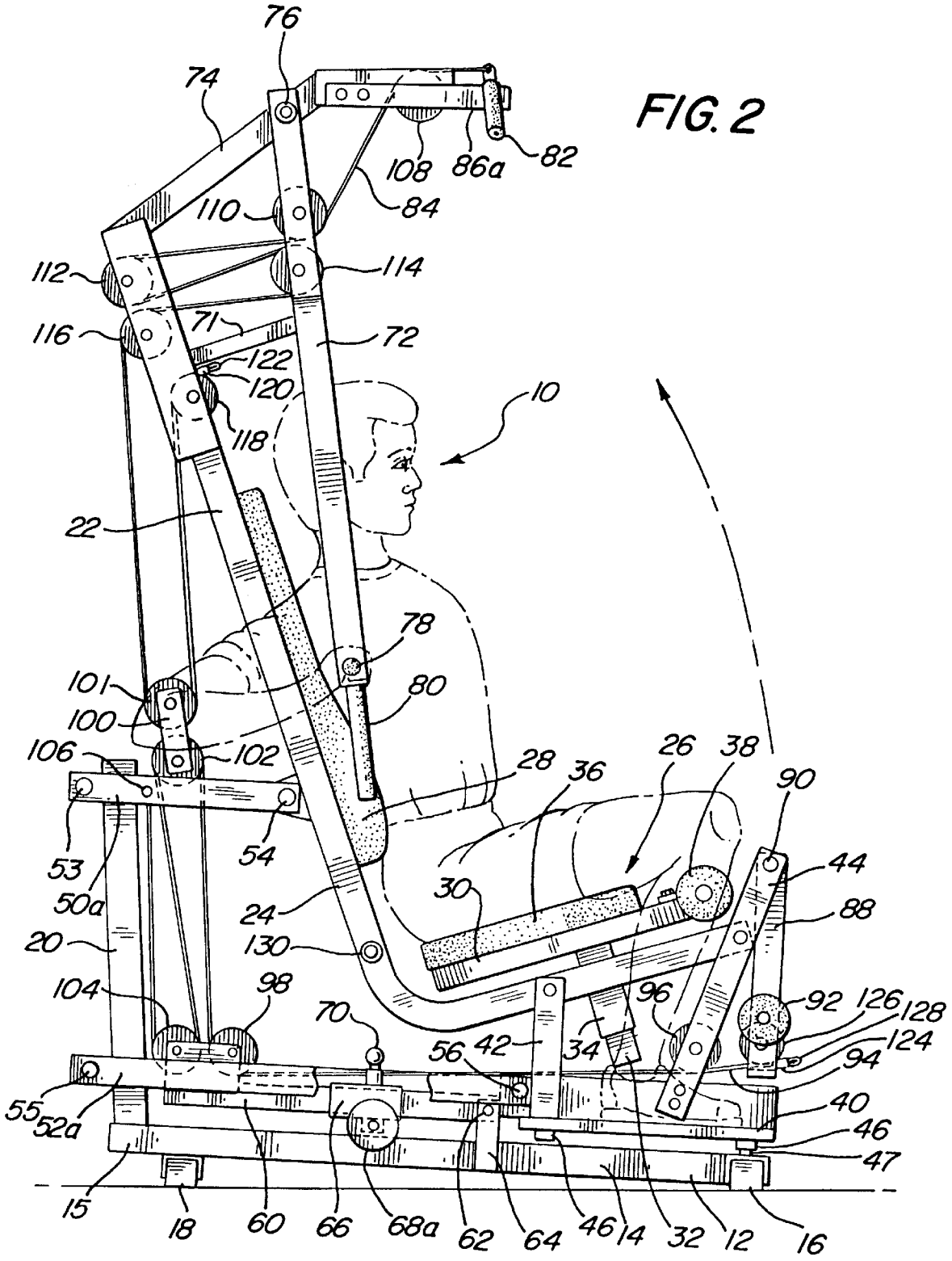
FIG. 2 is a side elevation view of the exercise machine of FIG. 1 showing it in its rest position.
Figure 3:
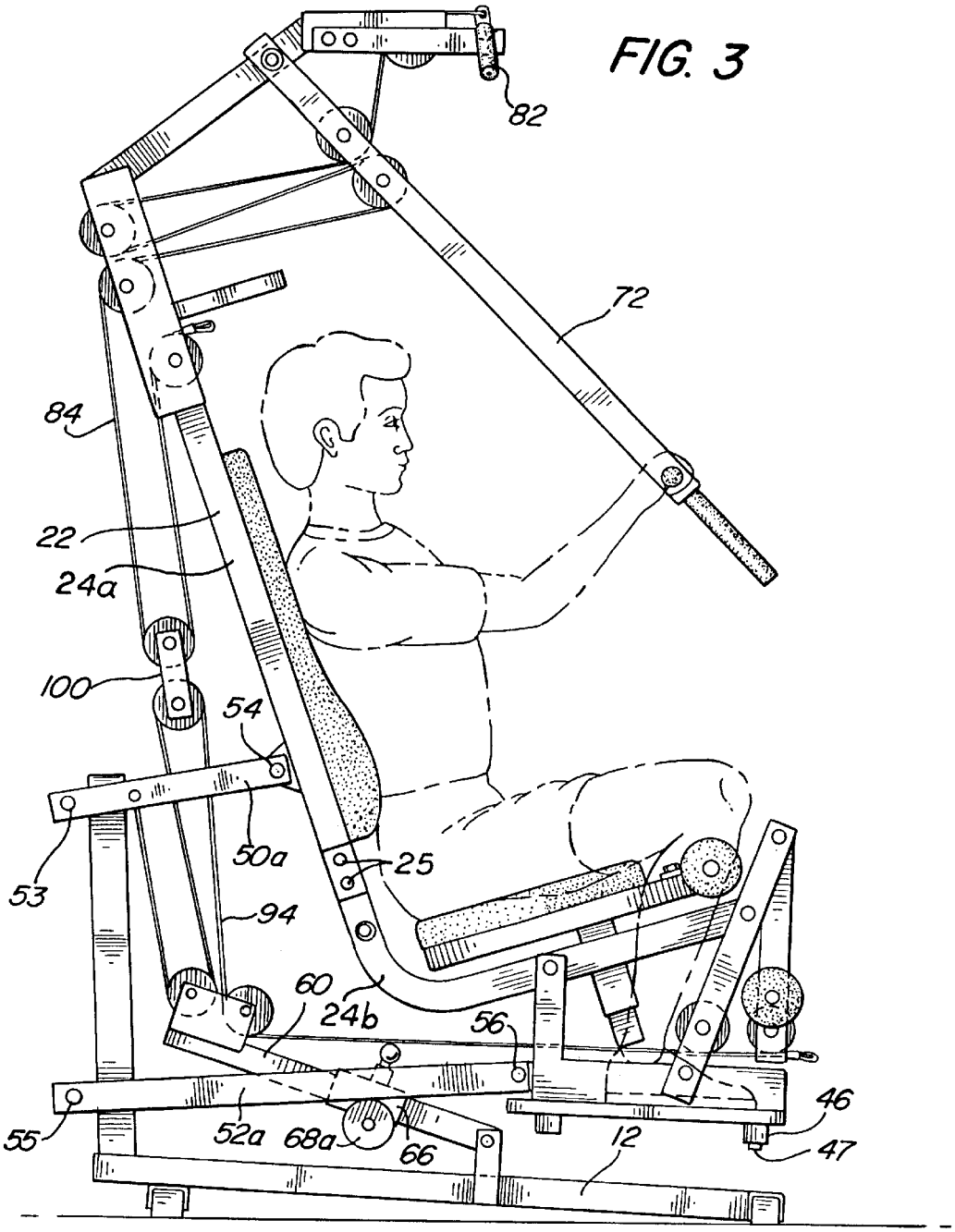
FIG. 3 is a side elevation view of the exercise machine of FIG. 1 showing it in an elevated position.

FIGS. 1–3 illustrate an apparatus 10 constructed in accordance with the present invention. The apparatus is supported by a fixed frame 12 which comprises a main longitudinal member 14. Frame member 14 abuts forward transverse support member 16 and rests on rear transverse support member 18. Upright frame member 20 is secured to rear end 15 of frame member 14.

Fixed frame 12 supports a movable subframe 22 comprising a generally L-shaped member 24. Member 24 consists of an upper portion 24*a*, and a lower portion 24*b* joined together by bolts 25. The subframe includes a seat 26 and a back rest 28 to support a user while performing exercises with apparatus 10. It should be observed that, since both seat 26 and back rest 28 are secured to subframe member 24, the relative positions of the support cushions remain fixed while performing exercises, unlike certain prior art devices such as the Gravity Edge™ referred to above.

Seat 26 is secured to subframe member 24 so that it can be adjusted vertically to accommodate users of varying sizes. To provide adjustability, seat frame 30 includes a downwardly extending member 32 which telescopes within tube member 34 secured to subframe member 24. The seat is secured at a desired elevation with a pop pin (not shown) as is common practice for exercise equipment. Seat frame 30 supports seat cushion 36 and knee cushion 38. The latter is provided mainly for support when performing a leg extension or leg curl exercise as more fully described below. When performing other exercises, the user's knees will generally straddle knee cushion 38 as shown in FIG. 1.

Subframe 22 includes a foot support platform 40 suspended from member 24 by members 42 and 44. Cross members 46 provide lateral support for platform 40. Stops 47 on the underside of forward cross member 46 rest against transverse frame member 16 when subframe 22 is in its rest position (illustrated in FIG. 2). Stops 47 are adjustable in height so that the rest position of subframe 22 may be adjusted vertically. The utility of this adjustment will be explained below.

Subframe 22 is coupled to fixed frame 12 by upper pivot arms 50*a*, 50*b* and lower pivot arms 52*a*, 52*b*. Upper pivot arms 50*a*, 50*b* are coupled to upright frame member 20 at pivot 53 and to subframe member 22 at pivot 54. In like fashion, lower pivot arms 52*a*, 52*b* are coupled to upright member 20 at pivot 55 and to subframe member 42 at pivot 56. Subframe 22 is thus coupled to fixed frame 12 by a four-bar linkage so that it remains relatively level as it is lifted from the rest position. The seating position actually reclines somewhat as the subframe is elevated owing to the fact that upper pivot arms 50*a*, 50*b* are shorter than lower pivot arms 52*a*, 52*b*.

Other linkage arrangements may be used to couple the subframe to the fixed frame. For example, the subframe could be configured to slide or roll along a generally upright member of the fixed frame. Still other generally equivalent linkage arrangements will be apparent to persons of ordinary skill in the art of exercise equipment.

Lever arm 60, which is shown in greater detail in FIG. 4, is pivotally coupled to fixed frame 12 at pivot 62, the latter being supported by bracket 64. Carriage 66 is slidably disposed on lever arm 60 and carries rollers 68*a*, 68*b*. These rollers bear against the underside of lower pivot arms 52*a*, 52*b*, respectively. The position of carriage 66 along the length of lever arm 60 is selectable by the user with pop pin 70. This pin, which is spring biased in a downward direction, engages a selected one of a plurality of holes 69 in the upper surface of lever arm 60. As will be better appreciated from the discussion that follows, the position of carriage 66 along the length of lever arm 60 determines the amount of exercise resistance experienced by the user when performing the exercises that are available with apparatus 10 and also varies the height to which subframe 22 is lifted by the exercise stroke. As mentioned above, stops 47 allow the rest position of subframe 22 to be adjusted vertically. This permits pivot arms 52*a*, 52*b* to be aligned parallel with lever arm 60. In turn, this permits carriage 66 to be smoothly positioned anywhere along the lever arm. Although lever arm 60 is a preferred means for transmitting the load of subframe 22 to the cable and pulley system of the apparatus, it should be noted that the load could be transferred directly to one or more of the pivot arms. For example, a cable attachment could be made to a sleeve or carriage that is slidably positionable on the pivot arms.

The principal structural members of apparatus 10 are preferably constructed of square and rectangular section steel tubing as is common practice for exercise equipment. The individual members are joined by welding or by mechanical fasteners as appropriate in each case.

Apparatus 10 incorporates a plurality of operable members coupled to subframe 22 for performing exercises. One such operable member is press arm 72 which is pivotally coupled to subframe member 74 at pivot 76. Press arm 72 is provided with both horizontal grips 78 and vertical grips 80. When not in use, press arm 72 rests against stop member 71 which projects from subframe member 24. A second operable member is lat bar 82 which is suspended on cable 84 at a lat pull down station above the user's head. When not in use, lat bar 82 is retained on brackets 86*a* and 86*b* which extend forwardly from subframe member 74. A third operable member is leg extension arm 88, which is pivotally suspended from subframe member 44 at pivot 90. It is important to note that all of these operable members are mounted on the moving subframe structure and thus remain in a fixed relationship to seat 26 and back rest 28. This is in contrast to most prior art body weight resistance machines that have their operable members mounted on a stationary frame.

Each of the above-mentioned operable members is coupled through the cable and pulley system of apparatus 10 so that as the user exercises, subframe 22 is lifted, thereby providing exercise resistance. To illustrate this, consider first a leg extension exercise using exercise arm 88. As the user applies forward pressure against ankle cushion 92, lower cable 94, which is coupled to arm 88, is placed in tension. Cable 94 passes under pulley 96, which is rotatably mounted on subframe member 44, and then under pulley 98 which is rotatably mounted on lever arm 60. Cable 94 then passes over lower pulley 102 of floating pulley assembly 100 and downwardly under pulley 104 mounted on lever arm 60 adjacent to pulley 98. Cable 94 continues upwardly and is secured between upper pivot arms 50*a*, 50*b* at location 106. As exercise arm 88 is moved forwardly, lever arm 60 is drawn upwardly by the action of cable 94 on pulleys 98 and 104. This, in turn, causes lower pivot arms 52*a*, 52*b* to be lifted by rollers 68*a*, 68*b*, respectively. The lifting force is thus communicated to subframe 22 causing it to be elevated in a nearly linear vertical path as shown by the dashed arrow in FIG. 2.

In a similar fashion, operation of press arm 72 causes subframe 22 to be lifted from its rest position. Upper cable 84, one end of which is coupled to lat bar 82, is routed over pulley 108 on bracket member 86 and then around pulleys 110, 112, 114 and 116 which are alternately mounted on press arm 72 and subframe member 24. Cable 84 then passes around pulley 101 of floating pulley assembly 100 and upwardly over pulley 118 on subframe member 24. Cable 84 terminates with cable stop 120 which is retained against subframe member 24 when cable 84 is in tension. As the user moves press arm 72 forwardly to the position shown in FIG. 3, floating pulley assembly 100 is drawn upwardly causing lever arm 60 to be pulled upwardly by cable 94. Subframe 22 is thus lifted in the same manner described above in connection with operation of the leg extension exercise. It will be observed that use of lat bar 82 pulls downwardly on cable 84 and causes the same result, but without the force multiplying effect experienced with press arm 72 as a result of the serpentine path of cable 84 through pulleys 110–116.

As already mentioned, lower cable 94 is attached between upper pivot arms 50*a*, 50*b* at location 106. This attachment is preferably adjustable to accommodate variations in the lengths of cables 84 and 94 and also to periodically compensate for cable stretch. With this adjustment, which need not have a great range of travel, the cables can be placed in a taut condition while subframe 22 is in its rest position. This removes any slop in the operation of the various operable members. It will be recognized that adjustment of the cable length at attachment 106 will influence the position of lever arm 60, and thus further adjustment of stops 47 may be necessary to maintain a parallel relationship between lever arm 60 and lower pivot arms 52*a*, 52*b*.

As mentioned above, cable 84 terminates with cable stop 120 at pulley 118, which is slightly above and behind the user's head. A loop 122 is secured to this end of cable 84 to permit the attachment of an auxiliary exercise bar or strap (not shown). Additional exercises, such as an abdominal crunch or overhead triceps, can thus be performed from this exercise station. Cable 94 also terminates with a cable stop 124 at pulley 126 on leg extension arm 88. Loop 128 is provided at the end of cable 94 to provide a low pulling point for additional exercises. For example, arm curls and upright row exercises may be performed while standing on platform 40 with an auxiliary exercise bar coupled to an extension chain or cable attached to loop 128. It should be noted that a number of exercises may also be performed using this low pulling point while standing on the floor adjacent to apparatus 10. In this regard, the weight of subframe 22 alone is more than adequate for performing a number of exercises, such as side leg raises.

While the combined weight of subframe 22 and the user seated thereon is generally adequate for providing the maximum desired exercise resistance, additional resistance may be desired by certain users. In this situation, auxiliary weights may be added to subframe 22 on support bars 130. Such auxiliary weights may comprise disc-shaped weight plates of the type that are widely used for barbells and dumbbells.

Figure 5:
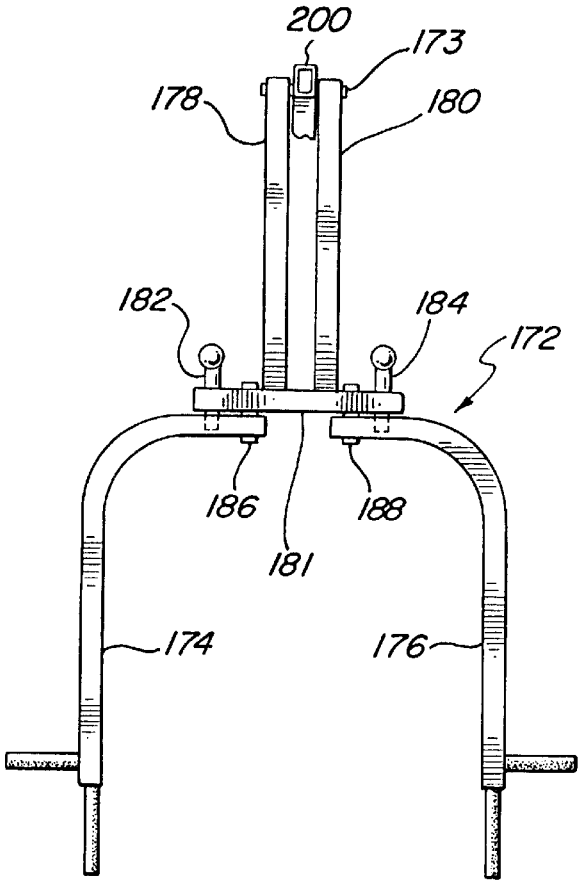
FIG. 5 is a front elevation view of an alternative press arm for use with the exercise machine of FIG. 1.
Figure 6:
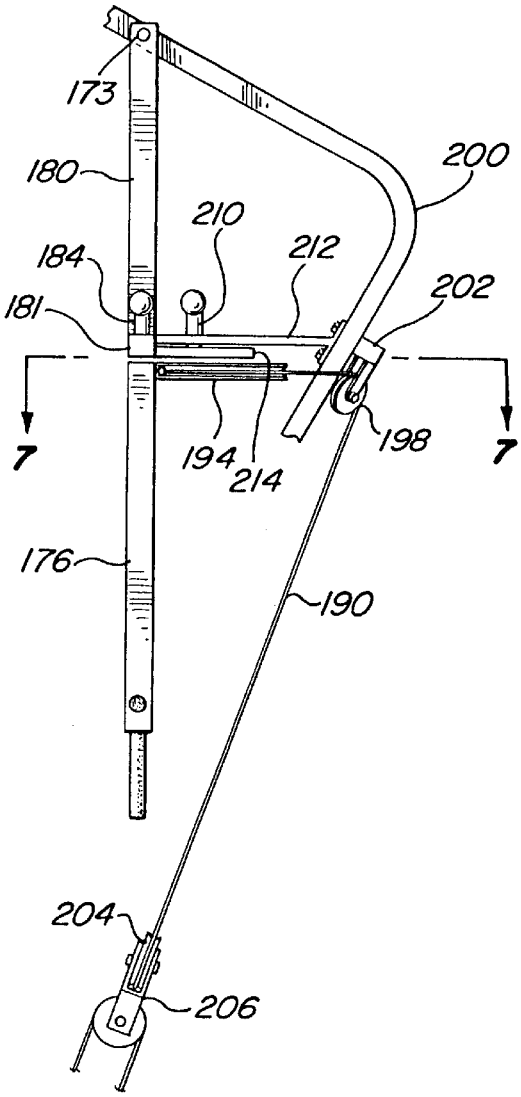
FIG. 6 is a side elevation view of the press arm of FIG. 5.
Figure 7:
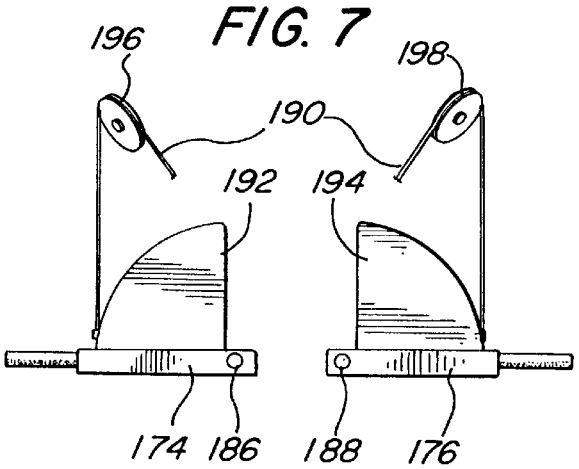
FIG. 7 is a partial cross-sectional view taken through line 7—7 of FIG. 6.

In an alternative embodiment of the present invention, press arm 72 may be replaced with press arm 172 as shown in FIGS. 5–7. Press arm 172 is configured to be used as a conventional press arm, but may also be used to perform a pectoral fly exercise. Upper press arm members 178 and 180 are pivotally coupled to frame member 200 at pivot 173. For use as a conventional press arm, individual arm members 174 and 176 are locked with respect to cross member 181 by pins 182 and 184, respectively. To perform the pectoral fly exercise, pins 182 and 184 are retracted so that arms 174 and 176 are free to rotate about pivots 186 and 188, respectively. In addition, pin 210 is inserted through press arm stop member 212 and into bar 214, which is attached to cross member 181. This locks the upper press arm assembly in position so that it cannot rotate about pivot 173. A plurality of holes for pin 210 are preferably provided in bar 214 so that arms 174, 176 may be optimally positioned with respect to the seat for performing the pectoral fly exercise.

Opposite ends of cable 190 are secured to sectors 192 and 194, which are attached to arms 174 and 176, respectively. Cable 190 is reeled around pulleys 196 and 198 mounted on subframe arm 202 and around floating pulley 204. Pulley 204 is the upper member of floating pulley assembly 206 which communicates with the remainder of the apparatus in the same manner as discussed above.

In yet a different configuration, the press arm may combine the features of both press arms 72 and 172. In this regard, a press arm with pulleys 110 and 114 and the cable rigging as shown in FIGS. 1–3 may be provided with folding pec fly arms similar to arms 174 and 176 of FIGS. 5–7. In this arrangement, lower cable 94 of apparatus 10 may be conveniently extended from attachment point 106 (this fitting being omitted) to a pulley or "Y" fitting at which it would be coupled to cable 190. The exercise resistance for press exercises would thus be communicated through upper cable 84 with the force multiplying effect of pulleys 110–116, whereas exercise resistance for the pec fly exercise would be communicated through lower cable 94 and cable 190. This arrangement obviates the need for pin 210 since operation of the pec fly arms against the relatively lower amount of resistance communicated by cables 94 and 190 would not tend to displace the press arm assembly about the press action pivot (76 in FIGS. 1–3 or 173 in FIGS. 5–7).

Figure 8:
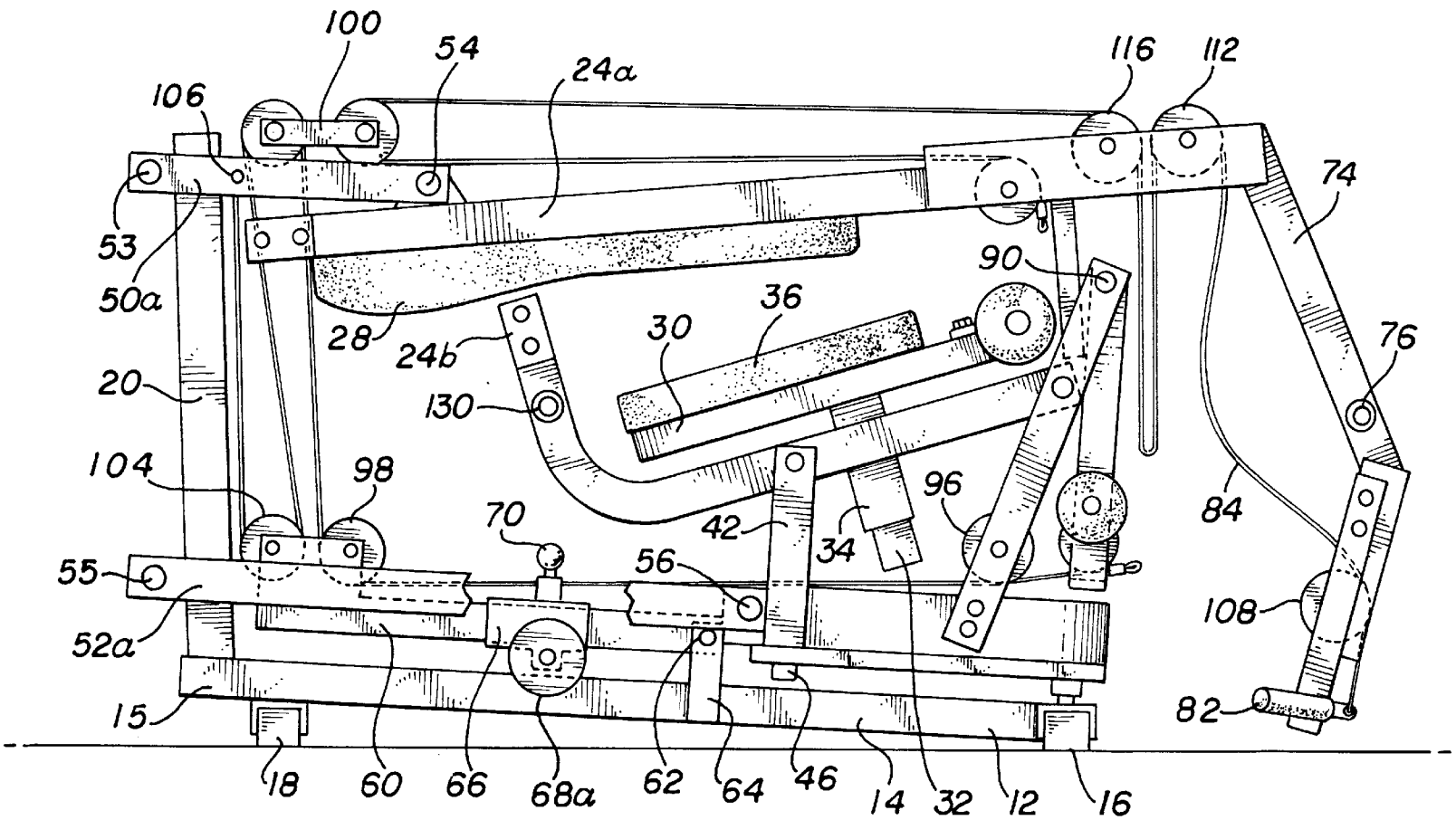
FIG. 8 is a side elevation view of the exercise machine of FIG. 1 in a folded configuration for shipping or storage.

With reference again to the embodiment illustrated in FIGS. 1–4, and with particular reference to FIGS. 2 and 3, an important aspect of the present invention involves the separability of subframe member 24 into upper portion 24*a* and lower portion 24*b*. With bolts 25 removed, upper portion 24*a* can be folded forwardly and downwardly on pivots 53 and 54 to a substantially horizontal position as illustrated in FIG. 8. This results in a much more compact configuration so that apparatus 10 can be conveniently shipped and/or stored. Press arm 72 is preferably removed from the apparatus at pivot 76 since it would otherwise strike fixed frame members 90 before the upper portion of the subframe is fully lowered. Pulleys 110 and 114 are removed from the press arm so that cable 84 may be left in place with the subframe lowered. However, even leaving press arm 72 in place would allow the upper portion of the subframe to be lowered substantially, thereby reducing the total volume occupied by apparatus 10. Moreover, the configuration of press arm 72 may be suitably altered to fit around fixed frame members 90 so that the upper portion of the subframe may be fully collapsed without removing the press arm. Furthermore, using the press arm configuration shown in FIGS. 5–7, the individual arm members can be folded in to allow the subframe to be collapsed without removing the press arm.

Figure 9:
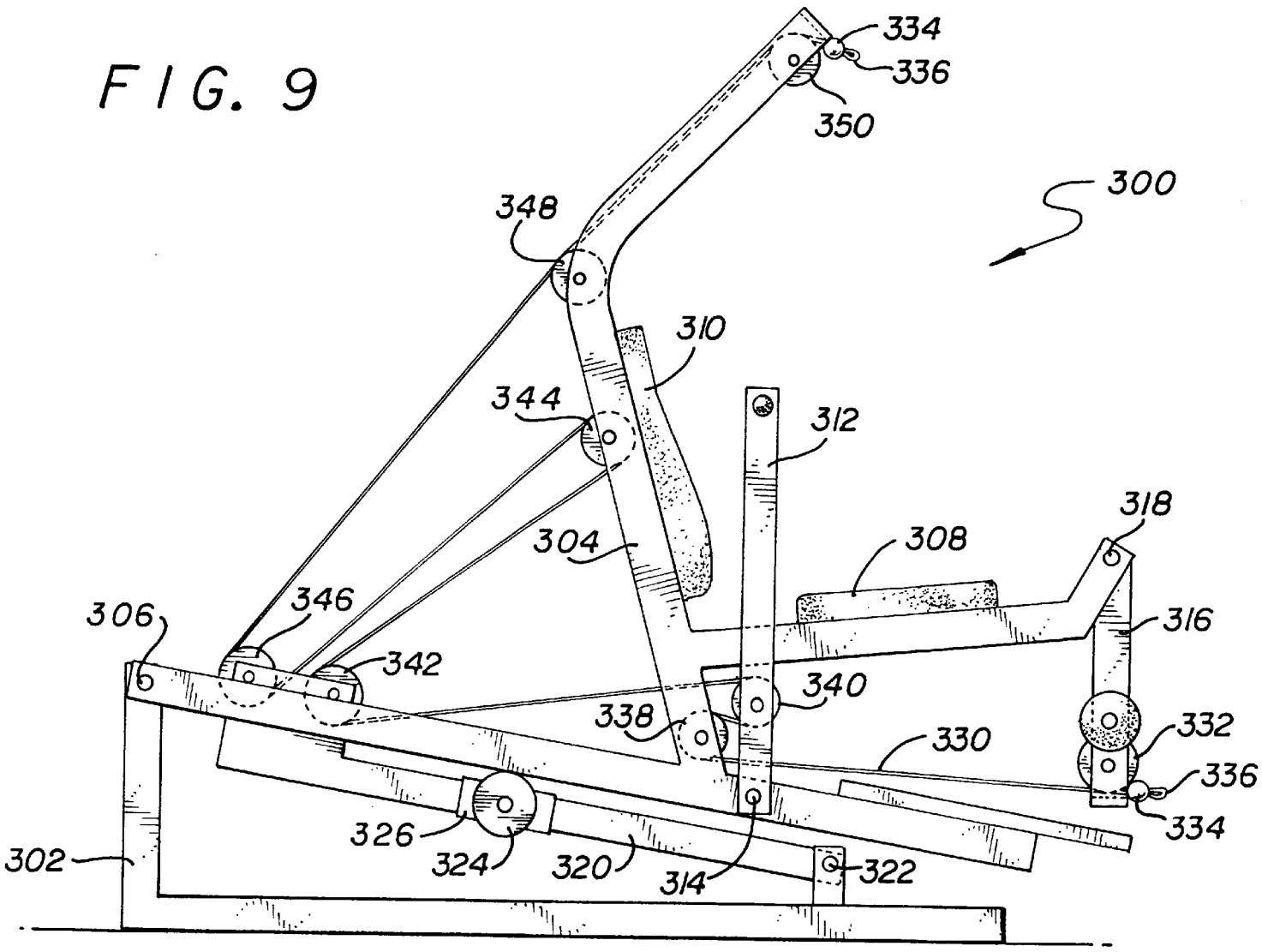
FIG. 9 is a side elevation view of an alternative embodiment of the present invention.

Referring now to FIG. 9, a further alternative embodiment of the present invention is illustrated. In this embodiment, apparatus 300 employs a single pivot arrangement in contrast to the four-bar linkage employed in the previously described embodiment. Subframe 304 of apparatus 300 pivots with respect to stationary frame 302 only at pivot point 306. Subframe 304 is otherwise generally similar to subframe 22 of the previously described embodiment, but is generally more compact.

Subframe 304 carries seat cushion 308 and back cushion 310. Press arm 312 is pivotally coupled to subframe 304 at pivot 314 which is located below the operator's seat. This is in contrast to the previously described embodiment, wherein the press arm is suspended from a pivot above the operator's seat. Leg extension arm 316 is also pivotally coupled to subframe 304 at pivot 318.

Lever arm 320 is pivotally coupled to the stationary frame at pivot 322. Subframe 304 is supported on roller 324, which is rotatably mounted on carriage 326. As in the previously described embodiment, carriage 326 is selectably positionable along lever arm 320 for the purpose of adjusting the amount of exercise resistance communicated to the various exercise stations.

The cable and pulley system of this embodiment is somewhat simpler than that of the previously described embodiment. Beginning at leg extension arm 316, a single cable 330 is guided under pulley 332. The end of cable 330 is fitted with ball stop 334 and a loop 336 allowing the cable end to be used for low pull exercises. Cable 330 extends rearwardly and loops over pulley 338, which is rotatably mounted on subframe 304. Cable 330 then loops around pulley 340 which is rotatably mounted on press arm 312. Cable 330 continues rearwardly and loops around pulley 342 which is rotatably mounted at the rear of lever arm 320. Cable 330 then loops around pulley 344 rotatably mounted on subframe 304 and returns back around pulley 346 on lever arm 320. Cable 330 proceeds upwardly and forwardly over pulley 348 on subframe 304 and terminates at pulley 350, also on subframe 304. This end of cable 330 is also fitted with a ball stop 334 and a loop 336. This loop is used to perform lat pull exercises.

When cable 330 is displaced by pulling on either of loops 336, or by pushing forward on either the press arm or the leg extension arm, the cable acts on pulleys 342 and 346 to pull lever arm 320 upwardly about pivot 322. This, in turn, causes subframe 304 to be lifted by roller 324. Thus, as in the previously described embodiment, the combined weight of the operator and the subframe 304 is communicated as exercise resistance through the cable and pulley system. The ratio of the exercise resistance to the combined weight of the operator and subframe 304 is determined by the position of carriage 326 along lever arm 320. Moving carriage 326 closer to pivot 322 reduces the exercise resistance since there is less upward travel of the subframe for a given amount of cable displacement.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

I claim:

1. An exercise apparatus comprising:

a stationary frame;

a subframe movable with respect to the stationary frame, said subframe having a support for a user of the apparatus and an operable member for performing an exercise;

linkage means for movably coupling the subframe to the stationary frame;

resistance communication means coupled to the operable member for communicating a predetermined ratio of the combined weight of the subframe and a user as an exercise resistance;

said subframe including a generally upright structural member extending above a highest elevation of the stationary frame, said structural member comprising a lower portion and an upper portion, said lower and upper portions being separable at a joint, said upper portion of the structural member pivotally coupled to the stationary frame so as to be foldable when separated from said lower portion.

2. The exercise apparatus of claim 1 wherein said linkage means comprises upper and lower pivot arms.

3. The exercise apparatus of claim 2 wherein said upper portion of the structural member is pivotally coupled to the upper pivot arm.

4. The exercise apparatus of claim 1 wherein said operable member is a press arm.

5. The exercise apparatus of claim 1 wherein the upper portion of the structural member is pivotally coupled to the stationary frame such that said upper portion of the structural member is foldable to a substantially horizontal position.

* * * * *

UNITED STATES PATENT AND TRADEMARK OFFICE

CERTIFICATE OF CORRECTION

PATENT NO. : 5,944,641
DATED : August 31, 1999
INVENTOR(S) : Habing

It is certified that error appears in the above-identified patent and that said Letters Patent is hereby corrected as shown below:

Title page,
At Attorney, Agent or Firm, delete "Sokoloff,Taylor" and insert
-- Sokoloff, Taylor --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*